US005946540A

United States Patent [19]

Harada et al.

[11] Patent Number: 5,946,540

[45] Date of Patent: Aug. 31, 1999

[54] DOCUMENT FEEDER HAVING A CURVED DOCUMENT TRANSPORTATION PATH

[75] Inventors: Hiroyuki Harada; Toru Tanjo; Kazuhisa Kondo; Jun Kusakabe; Masahiro Sako; Hiroshi Kobayashi, all of Osaka, Japan

[73] Assignee: Mita Industrial Co., Ltd., Osaka, Japan

[21] Appl. No.: 09/005,844

[22] Filed: Jan. 12, 1998

[30] Foreign Application Priority Data

Jan. 17, 1997 [JP] Japan ..... 9-007067

[51] Int. Cl.[6] ..... G03G 15/00

[52] U.S. Cl. ..... 399/372; 271/3.24; 271/277; 399/367

[58] Field of Search ..... 399/361, 365, 399/367, 372, 373, 374; 271/3.24, 3.2, 272, 277; 355/24, 23

[56] References Cited

U.S. PATENT DOCUMENTS

| | | | |
|---|---|---|---|
| 4,278,344 | 7/1981 | Sahay | 399/374 |
| 4,579,444 | 4/1986 | Pinckney et al. | 399/372 |
| 4,842,263 | 6/1989 | Robertson | 271/272 X |
| 4,935,775 | 6/1990 | Ueda et al. | 399/367 X |
| 5,119,145 | 6/1992 | Honjo et al. | 399/374 X |
| 5,344,134 | 9/1994 | Saeki et al. | 271/272 X |
| 5,597,153 | 1/1997 | Maruyama et al. | 271/3.2 X |
| 5,784,680 | 7/1998 | Taruki | 399/374 |
| 5,887,865 | 3/1999 | Ishimaru | 399/373 X |

*Primary Examiner*—Susan S. Y. Lee

*Attorney, Agent, or Firm*—Smith, Gambrell & Russell, LLP; Beveridge, DeGrandi, Weilacher & Young Intellectual Property Group

[57] ABSTRACT

A document feeder which has a document transportation path curved with a curvature radius such that a document original is reversed and fed therethrough to a document setting surface. The document feeder further includes a pair of rollers respectively disposed inside and outside of the curvature of the document transportation path in an opposed relation and adapted to hold the document original therebetween for guiding the document original to the document setting surface. The rollers abut against each other in a position upstream of the vertex of the curvature of the document transportation path with respect to a document transportation direction.

3 Claims, 4 Drawing Sheets

DOCUMENT FEEDER HAVING A CURVED DOCUMENT TRANSPORTATION PATH

BACKGROUND OF THE INVENTION

1. Field of the Invention

The present invention relates to a document feeder to be applied to an image processing apparatus such as a copying machine, a facsimile machine or an image reader.

2. Description of Related Art

Automatic document feeders are conventionally known which are applied to copying machines and the like and adapted to separate document originals set on a document placing plate on a one-by-one basis by a separator mechanism and feed the separated document original to a copying position on a platen glass through a document transportation path. The document feeder of this type typically employs a transportation path 320 curved with a predetermined curvature radius as shown in FIG. 6. In this case, a pair of registration rollers 321 responsible for secondary document feeding are provided in an abutting relation at a vertex 322 of the curvature of the transportation path 320. In other words, the pair of registration rollers 321 are provided in such a manner that a plane 323 including axes 321*a* and 321*b* of the respective rollers is generally parallel to a surface of a contact glass 324.

Recently, there has been an increasing tendency to reduce the height of an automatic document feeder in order to meet the demand for the size reduction of a copying machines. This involves the reduction of the curvature radius of the document transportation path 320 which, in turn, has a sharper curvature. Therefore, a document original P should be greatly curved as shown by a solid line in FIG. 6 to ensure that the document original can smoothly be guided to the curvature vertex 322 at which the pair of registration rollers 321 abut against each other.

In the prior-art document feeders, however, the document original P approaching the curvature vertex 322 is subject to a transportation force only from a separator mechanism 325. Such a transportation force alone is insufficient for bending the document original P to conform to the sharp curvature of the document transportation path. Hence, when the document original P is fed in a virtually unbent state into the document transportation path 320 as shown by a two-dot-and-dash line in FIG. 6, the document original may bump against an outer interior wall 320*a* of the document transportation path 320 before reaching the abutment position of the pair of registration rollers 321 located at the curvature vertex 322. As a result, document feeding failures such as a document transportation delay is more likely to occur in primary document feeding.

Since the pair of registration rollers 321 are located at the curvature vertex 322, the document original P is reversed for the secondary feeding thereof during the transportation thereof. At this time, the pair of registration rollers 321 are required to transport the curved document original P in the course of the reversal thereof, so that the document original P is forcibly pulled by the registration rollers 321. Therefore, a relatively large driving force is required for driving the pair of registration rollers 321, resulting in a heavy load on a motor for driving the pair of registration rollers 321.

This phenomenon is particularly noticeable in the case where a thick and stiff document original (such as having a stiffness of 160 $g/m^2$ or 200 $g/m^2$) is fed.

SUMMARY OF THE INVENTION

It is an object of the invention to provide a document feeder which ensures that a document original can smoothly be guided to an abutment position of a pair of rollers through a document transportation path even if the document transportation path has a smaller curvature radius.

It is another object of the invention to provide a document feeder which is adapted to reduce a load to be exerted on driving means for driving the pair of rollers.

A document feeder according to the present invention comprises: a document transportation path curved with a curvature radius such that a document original is reversed and fed therethrough to a document setting surface; and a pair of rollers respectively disposed inside and outside of the curvature of the curved document transportation path in an opposed relation and adapted to hold the document original therebetween for guiding the document original to the document setting surface. The pair of rollers abut against each other in a position upstream of a vertex of the curvature of the curved document transportation path with respect to a document transportation direction. Incidentally, the abutment position of the rollers may be located at a higher vertical level than the curvature vertex of the document transportation path. Further, a plane including the axes of the respective rollers may be inclined at a predetermined angle with respect to the document setting surface.

In accordance with the invention, the abutment position of the pair of rollers is located upstream of the curvature vertex of the curved document transportation path and, even if the document original is not curved sufficiently to conform to the curvature of the document transportation path, the document original can be guided to the abutment position of the pair of rollers without bumping against an interior wall of the document transportation path. Hence, even if the document transportation path has a small curvature radius, the document original can smoothly be guided therethrough to the abutment position of the pair of rollers.

Since the so-called secondary document feeding can be started before the document original reaches the curvature vertex, the secondary document feeding may be accomplished by applying a transportation force to the document original in a virtually unbent state. This eliminates the need for forcibly pulling the document original and, hence, a relatively small driving force suffices for driving the rollers. Thus, a load to be exerted on roller driving means is reduced in comparison with the prior art. This allows for the use of driving means having a smaller driving force generating capacity, thus accomplishing the cost reduction.

The foregoing and other objects, features and effects of the present invention will become more apparent from the following description of the preferred embodiment with reference to the attached drawings.

DESCRIPTION OF THE PREFERRED EMBODIMENTS

Figure 1:
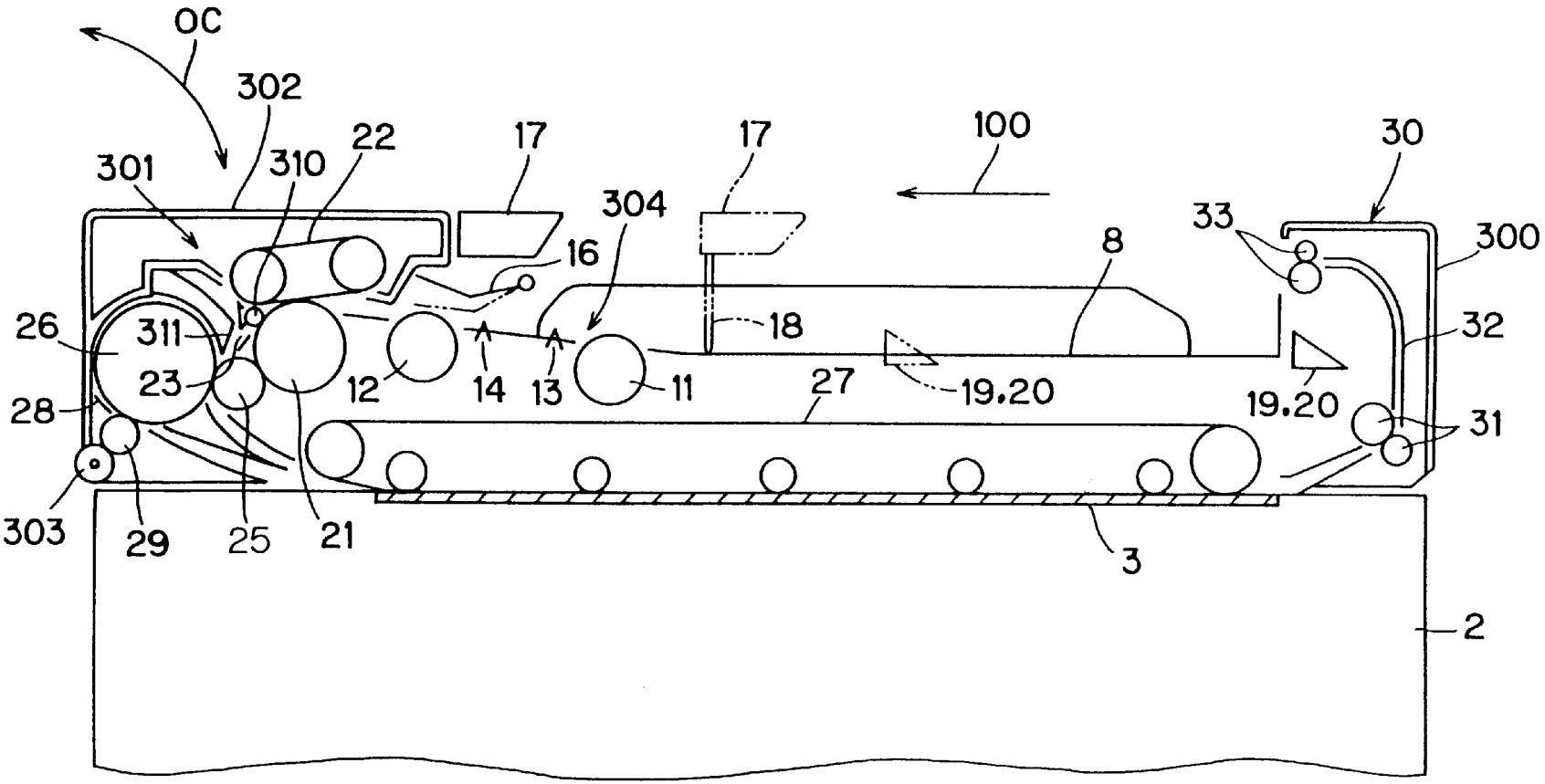
FIG. 1 is a sectional view schematically illustrating the internal construction of a recycle document feeder according to one embodiment of the present invention as viewed from the front side thereof.
Figure 2:
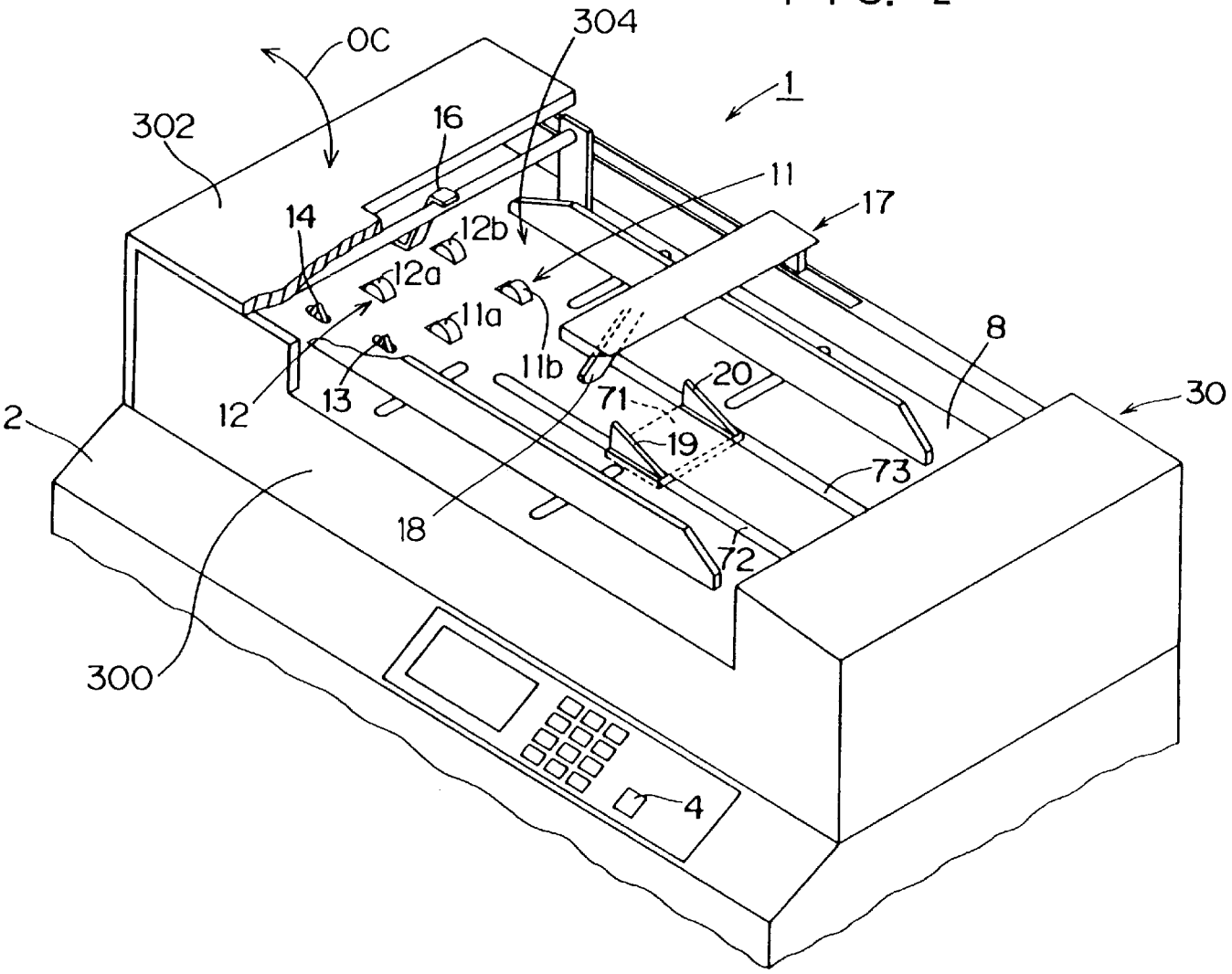
FIG. 2 is a partially cut-away perspective view of the recycle document feeder.

FIG. 1 is a sectional view schematically illustrating the internal construction of a recycle document feeder according to one embodiment of the present invention as viewed from the front side thereof. FIG. 2 is a partially cut-away perspective view of the recycle document feeder of FIG. 1.

The recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3.

The recycle document feeder 1 includes a main body 300 and a feeder cover 302 covering a feeding mechanism 301. The feeder cover 302 is attached to the main body 300 in such a manner that the feeder cover 302 can cover the feeding mechanism 301 and be opened pivotally about a pivotal axis 303 along a lower edge of the main body 300 in opening and closing directions OC. When the feeder cover 302 is opened, the feeding mechanism 301 can be exposed to the outside for a jam recovery operation.

A document placing plate 8 for holding thereon document originals to be fed onto the contact glass 3 is provided in the center of the upper face of the main body 300. The document placing plate 8 includes a feed out mechanism 304 for guiding the document originals to a predetermined feed position and assisting in the feeding of the document originals set in the feed position.

The feed out mechanism 304 includes a forward feed roller 11 and a main feed roller 12. As shown in FIG. 2, the forward feed roller 11 includes two unit rollers 11*a* and 11*b* spaced a predetermined distance from each other perpendicularly to a document transportation direction. The main roller 12 includes two unit rollers 12*a* and 12*b* spaced a predetermined distance from each other perpendicularly to the document transportation direction.

A preset switch 13 for detecting document originals placed on the document placing plate 8 is provided downstream of the forward feed roller 11 with respect to the document transportation direction. When a user places a stack of document originals on the document placing plate 8, the preset switch 13 is turned on to start driving the forward feed roller 11 and the main feed roller 12. As a result, the stack of document originals placed on the document placing plate 8 is transported in the direction of an arrow 100 (leftward as seen in FIG. 1).

A set switch 14 is provided downstream of the preset switch 13 with respect to the document transportation direction. The driving of the forward feed roller 11 and the main feed roller 12 is stopped after a lapse of a predetermined time period from a time point at which the set switch 14 is turned on by the transported document stack. Thus, the stack of document originals is set in the feed position.

When a print key 4 provided on the front upper portion of the copying machine body 2 is pressed with the document originals thus set in place, a partitioning unit 17 previously located in its home position (as indicated by a solid line in FIG. 1) above the forward feed roller 11 and the main feed roller 12 is moved in a direction opposite to the document transportation direction by a distance, which depends on the size of the document originals set in place, so as to be located in a position as indicated by a two-dot-and-dash line in FIG. 1.

The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of the document originals fed back onto the document placing plate 8 through a document discharge portion 30 are aligned and the document originals subjected to the document feeding operation are divided from the document originals yet to be subjected to the document feeding operation.

In response to the pressing of the print key 4, two action plates 19 and 20 previously located in their home positions within the document discharge portion 30 (as indicated by a solid line in FIG. 1) are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8, and adapted to be moved in unison along guide rails 72 and 73 spaced apart from each other perpendicularly to the document transportation direction on the document placing plate 8.

The action plates 19 and 20 are each comprised of a generally right-angled triangular planar plate having an edge inclined upward toward the document transportation direction as viewed horizontally and perpendicularly to the direction of their movement. Therefore, a document original first fed back onto the document placing plate 8 is guided by the inclined edges of the action plates 19 and 20 so that the leading edge of the document original is prevented from bumping against the trailing edges of the document originals set in the feed position and rested thereon.

Further, in response to the pressing of the print key 4, a pressing member 16 provided above the main feed roller 12 is shifted from an upper position as indicated by a solid line in FIG. 1 to a lower position as indicated by a two-dot-and-dash line thereby to press the leading edge of the document stack set in the feed position against the main feed roller 12. Thus, a sufficient transportation force is applied to the document originals to be fed into the document transportation path 23.

The feeding mechanism 301 is provided downstream of the main feed roller 12 with respect to the document transportation direction. The feeding mechanism 301 includes a separator roller 21 for separating and feeding the document originals one by one from the feed position into the document transportation path 23, and a separator belt 22 opposed to the separator roller 21. The document transportation path 23 is curved with a predetermined curvature radius, and adapted to reverse a document original and feed the reversed document original to a copying position on the contact glass 3.

The feeding mechanism 301 includes a transportation assist roller 310 for applying a transportation assist force to the document original fed into the document transportation path 23, and a document guiding member 311 for guiding the document original to an abutment position where a registration roller 25 abuts against a registration/reverse roller 26. The transportation assist roller 310 is provided in the vicinity of an entrance port of the document transportation path 23 and abuts against the separator roller 21. The document guiding member 311 defines a part of a wall of the document transportation path 23 and extends to the vicinity of the abutment position between the registration roller 25 and the registration/reverse roller 26.

When the print key 4 is pressed, the movement of the partitioning unit 17 and the action plates 19 and 20, the positional shift of the pressing member 16 and the driving of the forward feed roller 11 and the main feed roller 12 are started. As a result, the lowermost one of the document originals (in the document stack) is separated from the other document originals and fed into the document transportation path 23 by cooperation of the separator roller 21 and the separator belt 22.

The document original fed into the transportation path 23 is guided to an abutment position where the separator roller 21 abuts against the transportation assist roller 310. As a result, a transportation assist force is applied to the document original fed into the document transportation path 23. Thus, even if the document original is thick and stiff, the document original can be guided to the abutment position between the registration roller 25 and the registration/reverse roller 26 without bumping against the interior wall surface of the document transportation path 23. The document guiding member 311 guides the document original to the abutment position between the registration roller 25 and the registration/reverse roller 26.

The document original guided to the abutment position between the registration roller 25 and the registration/reverse roller 26 is further subjected to secondary feeding by the rollers 25 and 26 driven in a predetermined timing, and then placed in the copying position on the contact glass 3 of the copying machine body 2 by the transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, by the registration/reverse roller 26 and a reverse roller 29 and by the registration roller 25 and the registration/reverse roller 26, and placed on the contact glass 3 again by the transportation belt 27. Then, the document original is subjected to the image reading operation by the copying machine so that the image on the back side of the document original is first read. Thereafter, the document original is reversed again, and the image on the front side of the document original is read.

The document original subjected to the image reading operation is transported to the document discharge portion 30 by the transportation belt 27. The document original transported to the document discharge portion 30 is further transported through a discharging path 32 by a discharge roller pair 31, and then discharged onto the document placing plate 8 by a discharge roller pair 33. Thus, the document original subjected to the image reading operation is fed back onto the document placing plate 8.

Figure 3:
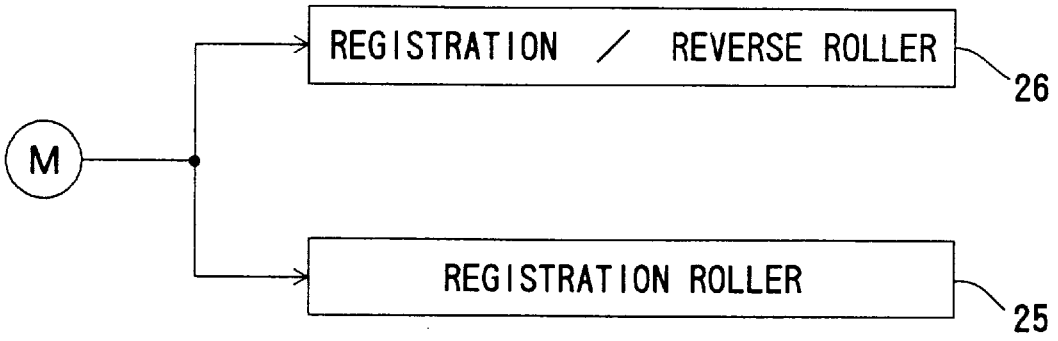
FIG. 3 is a diagram for explaining a mechanism for performing secondary document feeding.

FIG. 3 is a diagram for explaining a mechanism for performing the secondary document feeding. As described above, the secondary document feeding is performed by the registration roller 25 and the registration/reverse roller 26 which utilize a common feeding motor M as a drive source.

Figure 4:
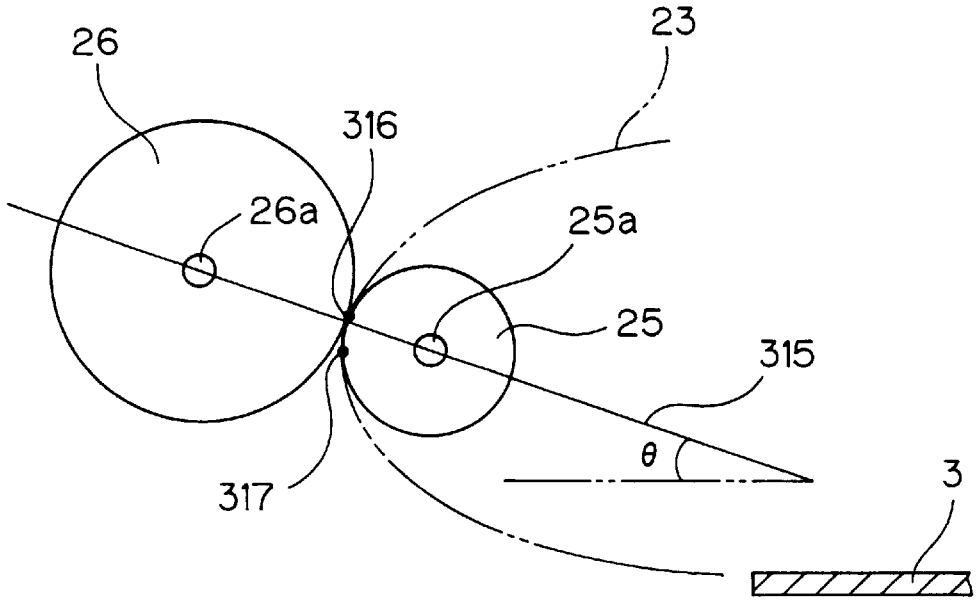
FIG. 4 is a diagram for explaining a positional relation between a registration roller and a registration/reverse roller.

FIG. 4 is a diagram for explaining a positional relation between the registration roller 25 and the registration/reverse roller 26. The registration roller 25 and the registration/reverse roller 26 are disposed in such a manner that a plane 315 including an axis 25*a* of the registration roller 25 and an axis 26*a* of the registration/reverse roller 26 (hereinafter referred to as "axial plane 315") is inclined at a predetermined angle θ (for example,θ=15) with respect to the contact glass 3 which is substantially parallel to a horizontal plane. More specifically, the registration/reverse roller 26 provided outside of the curvature of the document transportation path is located upstream of the registration roller 25 which is provided inside of the curvature of the document transportation path with respect to the document transportation direction. With this arrangement, the abutment position 316 between the registration roller 25 and the registration/reverse roller 26 is located upstream of a vertex 317 of the curvature of the curved document transportation path 23 with respect to the document transportation direction.

Figure 5:
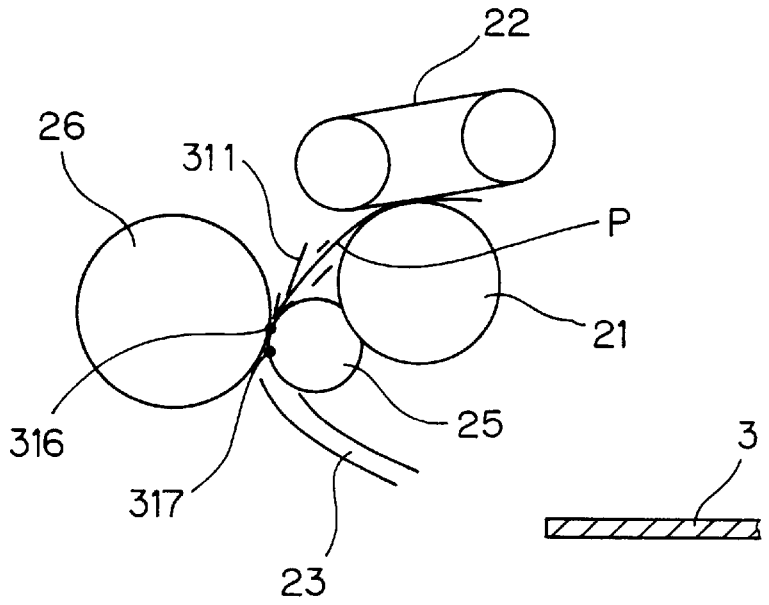
FIG. 5 is a diagram for explaining a document transporting operation.
Figure 6:
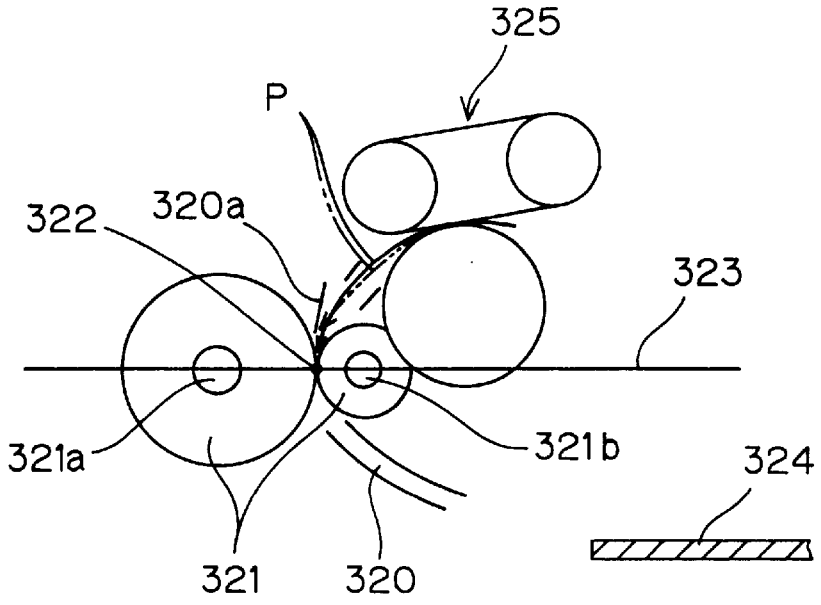
FIG. 6 is a diagram for explaining a document transporting operation in a prior art document feeder.

Therefore, the document original P fed into the document transportation path 23 is guided to the abutment position 316 between the registration roller 25 and the registration/reverse roller 26, as shown in FIG. 5, before the document original P reaches the curvature vertex 317 of the document transportation path 23. That is, the document original P is guided in a virtually unbent state to the abutment position 316 between the registration roller 25 and the registration/reverse roller 26. Hence, even if the document transportation path 23 has a sharp curvature for height reduction of the feeder, the document original can smoothly be guided to the abutment position between the rollers 25 and 26 without suffering a document feeding failure such as caused by the document original bumping against the interior wall of the document transportation path 23 in primary document feeding. Thus, the copying operation can properly be performed.

Further, since the secondary document feeding is started upstream of the curvature vertex 317 with respect to the document transportation direction, the secondary document feeding may be achieved by applying the transportation force to the document original in a virtually unbent state. This eliminates the need for forcibly pulling the document original but only requires a relatively small driving force for driving the registration roller 25 and the registration/reverse roller 26. As a result, a load exerted on the feeding motor M for driving the registration roller 25 and the registration/reverse roller 26 is reduced in comparison with the prior art document feeders.

While one embodiment of the present invention has thus been described, the invention is not limited to this embodiment. The embodiment described above is directed to a case where the present invention is applied to a recycle document feeder to be mounted on a copying machine. Otherwise, the invention can be applied to a recycle document feeder for a facsimile machine or for an image reading apparatus connected to a computer or the like. Further, the invention can be applied not only to the recycle document feeder but also to an automatic document feeder which is adapted to discharge document originals to a special tray after the image reading operation.

While the present invention has been described in detail by way of an embodiment thereof, it should be understood that the foregoing disclosure is merely illustrative of the technical principles of the present invention but not limitative of the same. The spirit and scope of the present invention are to be limited only by the appended claims.

This application claims priority benefits of Japanese Patent Application No. 9-7067filed on Jan. 17, 1997 under 35 USC 119, the disclosure thereof being incorporated herein by reference.

What is claimed is:

1. A document feeder, comprising:

a document transportation path curved with a curvature radius such that a document original is reversed and fed therethrough to a document setting surface; and a pair of rollers respectively disposed inside and outside of a curvature of the curved document transportation path in an opposed relation for holding a document original therebetween and guiding the document original to the document setting surface, the rollers abutting against each other in a position upstream of a vertex of the curvature of the curved document transportation path with respect to a document transportation direction, and the rollers being registration rollers driven according to predetermined timing to perform document feeding.

2. A document feeder as set forth in claim 1, wherein the rollers are disposed in such a manner that the abutment position thereof is located at a higher vertical level than the curvature vertex of the document transportation path.

3. A document feeder as set forth in claim 1, wherein the rollers are disposed in such a manner that a plane including axes of the respective rollers is inclined at a predetermined angle with respect to the document setting surface.

* * * * *